United States Patent [19]

Rodish

[11] 4,096,987

[45] Jun. 27, 1978

[54] REINFORCED PAPER BAG

[75] Inventor: John Rodish, Ft. Wright, Ky.

[73] Assignee: The Ritter Company, Cincinnati, Ohio

[21] Appl. No.: 718,408

[22] Filed: Aug. 30, 1976

[51] Int. Cl.[2] ..... B65D 33/02

[52] U.S. Cl. ..... 229/55; 229/DIG. 3; 229/DIG. 4; 428/174

[58] Field of Search ..... 229/55, DIG. 3, DIG. 4, 229/53; 428/174

[56] References Cited

U.S. PATENT DOCUMENTS

| | | | |
|---|---|---|---|
| 1,859,861 | 5/1932 | Ballou | 229/DIG. 3 |
| 2,053,116 | 9/1936 | Sperry | 229/53 X |
| 2,296,951 | 9/1942 | Rosen et al. | 229/DIG. 3 |
| 2,704,183 | 3/1955 | Stern | 229/DIG. 3 |
| 2,707,553 | 5/1955 | Yount | 229/DIG. 3 |
| 3,297,232 | 1/1967 | Fesco | 229/53 |
| 3,650,298 | 3/1972 | Delmar | 206/498 X |

FOREIGN PATENT DOCUMENTS

| | | | |
|---|---|---|---|
| 1,803,481 | 5/1970 | Germany | 229/55 |

*Primary Examiner*—Stephen P. Garbe

*Attorney, Agent, or Firm*—Melville, Strasser, Foster & Hoffman

[57] ABSTRACT

A paper bag of the type found in grocery stores which is reinforced by a plurality of narrow pleats extending lengthwise of the bag, the bag having corner defining pleats and additional pleats intermediate the corners of the bag, the pleats being folded down and secured to the bag material, preferably with the intermediate pleats adhered in a manner which permits them to expand under load, the pleats adding strength to the bag and permitting the use of lighter weight paper stock, thereby achieving savings in paper requirements as well as increased bag strength.

9 Claims, 5 Drawing Figures

REINFORCED PAPER BAG

BACKGROUND OF THE INVENTION

The present invention relates to paper bags and more specifically to kraft paper bags of the type used for groceries and other consumer commodities. In particular, the invention deals with the provision of a paper bag having greatly improved strength characteristics.

While efforts have hitherto been made to improve the strength characteristics of paper bags, such efforts have been directed primarily to the use of multiple thickness or multiwall bags having a plurality of layers or plies of bag stock, but obviously the cost of such bags is substantially greater than if only a single ply is employed. It has also been suggested to line a single ply bag with a liner which is expansible to compensate for forces tending to rupture the liner, the liner having folded sections which are freely unfoldable to effectively increase the size of the liner. Again, however, a multiple thickness of bag stock is required. In contrast, the present invention deals with single thickness bags and the integral reinforcement of the bag to greatly enhance its strength at minimal additional expense.

A conventional grocery bag is made from a flat sheet of kraft paper stock which is cut, folded and glued to form a seamed tubular body having a sealed bottom closure. The conventional grocery bag is normally formed from kraft paper stock having a basis weight of about 70 lbs. per ream (3000 sq. ft.), although higher basis weights are sometimes employed to insure adequate bag strength. The cost of a given bag is proportional to the cost of the paper from which it is formed, and since paper stock is sold on a weight basis, the greater its basis weight per ream, the lesser the quantity of paper per unit of weight. On a tonage basis, a ton of 40 lb. per ream (3000 sq. ft.) paper stock contains approximately 43% more paper, on a square foot basis, than does a ton of 70 lb. per ream (3000 sq. ft.) stock. While the cost of the paper stock may increase somewhat as its basis weight decreases, the cost differential, if any, is relatively small by comparison to the square footage of paper involved. Obviously, there is a great economic advantage to be achieved if grocery bags can be fabricated from 40 lb. stock and still afford the same or even greater strength characteristics as 70 lb. stock.

The present invention relates to a single ply reinforced bag construction which will permit the substitution of much lighter weight bag stock, such as from 70 to 40 lb. per ream, while maintaining or even improving the strength characteristics of the resultant bag.

SUMMARY OF THE INVENTION

In accordance with the present invention, a paper bag is formed with a series of relatively narrow longitudinally extending pleats which are folded down and secured to form multiple thickness areas of reinforcement for both the body walls and bottom closures of the bags, the pleats being located to perform the major vertical load carrying function. In the event of a puncture of the bag material between the pleats, they will limit the spread of the puncture and reduce the chances of the contents breaking through the bag. Aside from the formation of the pleats, the bags may be of conventional construction, with the bag forming stock tubed and seamed in conventional fashion, including the formation of a conventional bottom closure and the creasing of the body walls to provide opposing bellows by means of which the bags may be flat-folded for shipment and storage.

Preferably two types of pleats are utilized, the first comprising corner pleats which bridge the corners of the erected bag, and the second comprising intermediate pleats which reinforce the side and end walls of the bag at spaced apart intervals between the corners. The corner pleats are effectively double width pleats and are arranged to bridge and reinforce the corners of the bag, whereas the intermediate pleats are effectively of single width and are folded and adhesively secured in a manner which will permit them to expand (peel) under load.

Neither the number of pleats nor their size constitute limitations on the invention, and aside from the corner pleats, the number of intermediate pleats will be determined by the size of the bag and the desired spacing between adjacent pleats. As a representative example for forming a conventional 1/6 barrel grocery bag, which is the most popular size and is approximately 7 × 12 inches in cross-section, there preferably will be from 10 to 12 intermediate pleats in addition to the corner pleats, the number varying with the location and strength characteristics of the longitudinal seam by means of which the bag is tubed. It is also preferred that the folded over pleats, as well as the bottom closure flaps, be adhered together utilizing a waterproof adhesive which has been found extremely effective in maintaining the integrity of the pleats and bottom closure under humid and wet conditions.

DESCRIPTION OF THE PREFERRED EMBODIMENT

Figure 1:
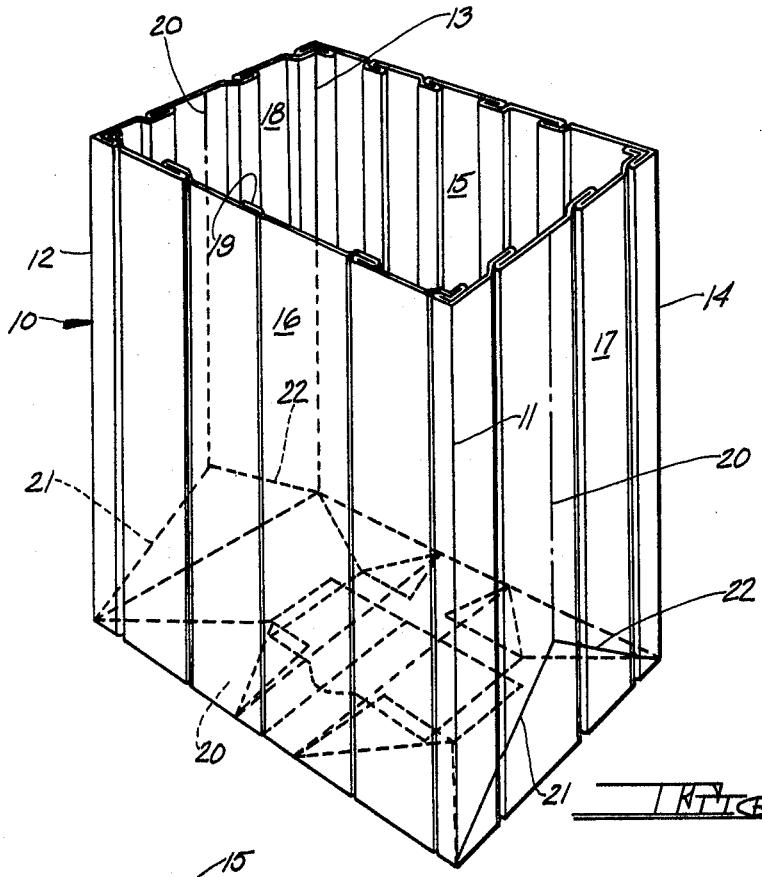
FIG. 1 is a perspective view of an erected paper bag reinforced in accordance with the invention.
Figure 2:
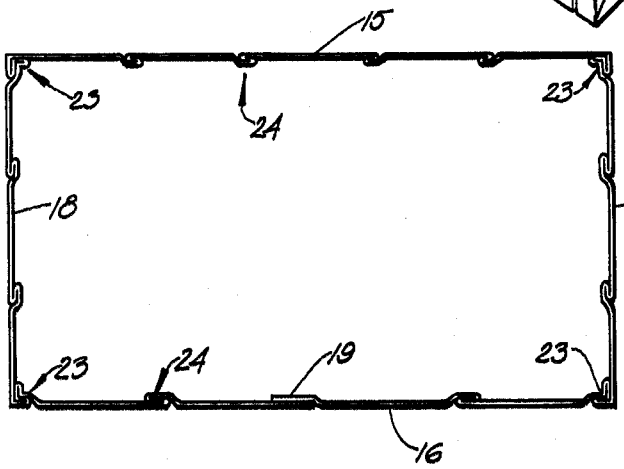
FIG. 2 is a top plan view of the erected bag.

Referring first to FIG. 1 of the drawings, a grocery bag constructed in accordance with the present invention is indicated generally at 10, the bag other than for the reinforcing pleats being of conventional construction. To this end, the bag is formed from conventional bag stock, except that the stock will be of substantially less basis weight than normally required for a bag of the same size and carrying capacity. In a preferred embodiment for the manufacture of a 1/6 barrel grocery bag, kraft paper stock having a basis weight of 40 lbs. per ream (3000 sq. ft.) will be substituted for the conventionally used 70 lb. basis weight stock. It is to be understood, however, that the basis weight of the paper stock does not constitute a limitation on the invention since the reinforced construction of the present invention can be utilized to enhance the strength of any bag irrespective of the basis weight of the paper stock from which it is formed.

In basic construction the bag 10 has a tubular body which is creased at spaced apart intervals to define corners 11, 12, 13, and 14, the corners defining the side edges of opposing side walls 15 and 16, and opposing end walls 17 and 18. The bag is tubed by means of a longitudinal glue seam 19 which is preferably medially disposed in one of the side walls, such as the side wall 16. The bottom closure of the bag, indicated generally at 20, will be of conventional construction, the bag tube being cut and creased to define overlapping flaps which, when folded and adhered together, provide a multiple thickness sealed bottom closure for the bag. The specific nature of the bottom closure does not constitute a limitation on the invention, and any desired bottom construction, such as a square or satchel-type bottom closure may be employed. It may be noted, however, that in accordance with the invention, the reinforcing pleats extend throughout the bottom closure flaps and serve to reinforce the bottom of the bag as well as its body walls. As in a conventional grocery bag, the opposite end walls of the bag will be creased to define lines of fold 20, 21, and 22, which permit the end walls 17 and 18 to bellows-fold so that the bag may be flat-folded with the opposing side walls 15 and 16 juxtaposed one upon the other. Conventional bag forming apparatus may be utilized for the tubing of the bag stock and the bottom forming and sealing operations, all of which are well known to the worker in the art.

In accordance with the invention the bag is reinforced by a set of four corner pleats, each of which is indicated generally at 23, and a series of intermediate pleats, each of which is indicated at 24, the intermediate pleats serving to reinforce the side and end walls of the bag. The manner in which the various pleats 23 and 24 are formed does not in itself constitute a limitation on the invention, and various types of pleating devices may be utilized to form, fold and adhesively secure the pleats, the pleating of the bag stock taking place prior to the tubing of the stock and its severance into individual bag lengths, which is followed by the folding and gluing of one end of each bag length to form a sealed bottom closure.

Figure 3:
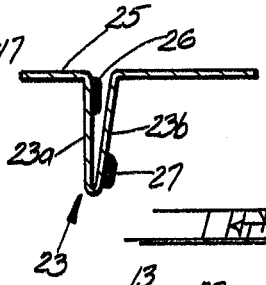
FIG. 3 is an enlarged fragmentary plan view illustrating an initial step in the formation of both a corner pleat and an intermediate pleat, including the application of adhesive thereto.
Figure 3:
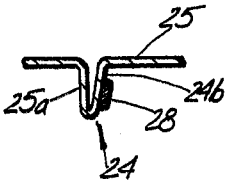

As seen in FIG. 3, each of corner pleats 23 is formed by folding and reversely folding the bag stock 25 to form an opposing pair of pleat sections **23*a* and 23*b* which are adhered together by an interposed longitudinally extending stripe of adhesive 26 which joins together the opposing sections 23*a* and 23*b* adjacent their free edges. In addition, a second longitudinal stripe of adhesive 27 is applied to the outside surface of one of the section, such as the section 23*b*, adjacent its opposite or folded edge. In similar fashion, and as also seen in FIG. 3, each of the intermediate pleats 24 is formed by folding and reversely folding the bag stock 25 to form opposing pairs of pleat sections 24*a* and 24*b*, and in the case of the intermediate pleats a longitudinally extending stripe of adhesive 28 is applied to the outer surfaces of one of the sections, such as the sections 20*b***.

Figure 4:
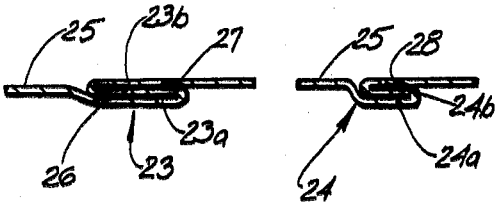
FIG. 4 is an enlarged fragmentary plan view similar to FIG. 3 but illustrating the pleats in their folded over and adhesively secured positions.
Figure 5:
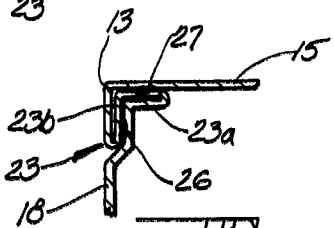
FIG. 5 is an enlarged fragmentary plan view of a corner pleat after folding to its corner defining condition.

Following the formation of the pleat sections and the application of the adhesive stripes, the pleats are then folded over to the position illustrated in FIG. 4, thereby providing multiple thickness areas of reinforcement. Thus, in the case of the corner pleats 23, the pleat section **23*b* is adhered by the adhesive stripe 27 to the area of the bag stock to which it is juxtaposed, with the section 23*a* adhered to the section 23*b* by the interposed adhesive stripe 26, thereby providing a triple thickness of bag stock in the area of the pleats. Similarly, the folding over of the intermediate pleats 24 results in the adhesive attachment of the pleat section 24*b* to the bag stock, although in this instance it is preferred that the sections 24*a* and 24*b* are free from adhesive attachment to each other, thereby permitting the intermediate pleats to expand under load. That is, if oppositely directed pulling forces are exerted on the intermediate pleats in the the plane of the sheet stock 25, pulling forces will be exerted which cause the pleat 24*b* to be peeled back on itself in the area of the adhesive stripe 28**, thereby permitting limited expansion of the bag walls.

The corner pleats 23, which are effectively twice the width of the intermediate pleats, are adapted to bridge the corners of the bag, the corner pleats being creased intermediate their opposite side edges, as along the crease line 13, to define a corner edge between the side and end walls 15 and 18, respectively. With this arrangement, the corner pleats provide triple thickness reinforcement in the planes of both the side and end walls, and the positioning of the adhesive stripes 26 and 27 is such that shearing forces rather than peeling forces are exerted on the corner pleats. As should now be apparent, the instant invention provides a reinforced bag construction which materially enhances the strength of the bag. Tests have indicated that a pleated bag constructed in accordance with the present invention from 40 lb. per ream stock performs as well or better than unreinforced bags of the same size constructed from 70 lb. per ream stock. In addition, by utilizing a waterproof adhesive, such as an acrylic base adhesive, the integrity of both the pleats and the bag bottom can be effectively maintained under humid and wet conditions.

While the invention has been described in an exemplary embodiment, it will be understood that modifications may be made in the invention without departing from its spirit and purpose. For example, while it is preferred to adhere the folded sections of the pleats in the manner previously described, the opposing sections of the intermediate pleats may be adhered to each other and folded over without attachment to the portions of the bag stock to which the folded over pleats are juxtaposed. The pleats may be adhered to each other and also to the bag stock, although where this is done the pleats are in shear and the effectiveness of the peeling action is lost. The size of the pleats may be varied, as may the difference in size between the corner and intermediate pleats, and while the corner pleats have been characterized as being effectively double width pleats as compared to the width of the intermediate pleats, it is to be understood that the terms are relative and are employed as a general characterization of their respective widths. For example, in a preferred embodiment, the sections of the intermediate pleats each has a width of $\frac{1}{4}$ inch in a 1/6 barrel grocery bag, whereas the width of each section of the corner pleats will be $\frac{3}{8}$ inch. While the invention is particularly suited for the reinforcement of single thickness bag stock, it should be readily apparent that its principles are applicable to coated and laminated stock.

The reinforced bag construction of the present invention also lends itself to plastic bags formed from diverse plastic materials. While and adhesive may be used to secure the pleats, ultrasonic or heat sealing techniques may be employed. Fabrics also may be used, in which event the pleats can be sewn, stitched, or bonded together using an adhesive or a fusible plastic material. In all cases lighter weights of bag material could be used than would be required if the bag were not reinforced in accordance with the invention.

It also should be apparent that the reinforced stock of the present invention could be used for other purposes, such as coverings for polystyrene or urethane insulating panels used in the construction of residences, mobile homes and commercial buildings. The pleated stock would replace the heavier weight materials bonded to the opposite sides of the panels, effecting a stronger unit at a lower cost. The reinforced stock also can be used for overwraps, bales and the like.

Accordingly, it is not intended that the invention be limited other than in the manner set forth in the claims which follow.

The embodiments of the invention in which an exclusive property or privilege is claimed are defined as follows:

1. A reinforced bag having enhanced load carrying capacity, said bag being formed from a single ply of sheet stock cut, folded and secured to define enclosing body walls meeting at corner edges and a bottom closure, a series of relatively narrow continuous pleats extending lengthwise of the body walls and across the bottom closure at spaced apart intervals, the pleats being spaced so as to perform the major load carrying function of the bag, with each corner edge of the bag bridged by one of said pleats, and with the remainder of the pleats extending lengthwise of the body walls intermediate the corner edges, said pleats each comprising a pair of reversely folded pleat sections folded over and juxtaposed to the bag stock, said pleats being permanently secured in their folded over condition so as to provide multiple thickness areas of reinforcement for the body walls and bottom closure of the bag when the bag is expanded to its fully opened condition, thereby enhancing the strength of the opened bag so as to permit a lighter weight sheet stock to be used than would be otherwise required for a bag of the same size and carrying capacity.

2. The reinforced bag claimed in claim 1 wherein said corner bridging pleats are wider than said intermediate pleats, the section of said corner bridging pleats being secured to the bag stock on opposite sides of the corner edges.

3. The reinforced bag claimed in claim 2 wherein the reversely folded sections of the intermediate pleats are free from attachment to each other.

4. The reinforced bag claimed in claim 2 wherein portions of the reversely folded sections of the corner bridging pleats are secured to each other.

5. The bag construction claimed in claim 1 wherein said pleat sections are secured to the bag stock by means of a waterproof adhesive.

6. For use in the manufacture of reinforced bags and the like formed from sheet stock, a single ply length of sheet stock having a plurality of relatively narrow pleats extending lengthwise thereof at spaced apart intervals throughout the width of the sheet stock, said pleats each comprising a pair of juxtaposed pleat sections lying in folded over relation relative to said sheet stock, said pleats being permanently secured in the folded over condition to provide multiple thickness areas of reinforcement extending lengthwise of the sheet stock, some of said pairs of reversely folded pleat sections being wider than the remaining pairs of pleat sections, said pairs of wider pleat sections being positioned to define the corners of a bag formed from said sheet stock, whereby to enhance the strength of the sheet stock so as to permit a lighter weight sheet stock to be used than would be otherwise required to provide stock of comparable strength.

7. The sheet stock claimed in claim 6 wherein the underlying sections of the folded over pleats are adhesively secured to the sheet stock.

8. The sheet stock claimed in claim 7 wherein some at least of said pairs of reversely folded pleat sections are free from adhesive attachment to each other.

9. The sheet stock claimed in claim 7 wherein some at least of said pairs of reversely folded pleat sections are adhesively secured to each other.

* * * * *